US008870492B2

(12) United States Patent
Stasiewich et al.

(10) Patent No.: US 8,870,492 B2
(45) Date of Patent: Oct. 28, 2014

(54) INTERLOCKING RIG MATS

(71) Applicant: Rig Mats of America, Inc., Billings, MT (US)

(72) Inventors: Brian Stasiewich, Billings, MT (US); Mark Schiffner, Billings, MT (US)

(73) Assignee: Rig Mats of America, Inc., Billings, MT (US)

( * ) Notice: Subject to any disclaimer, the term of this patent is extended or adjusted under 35 U.S.C. 154(b) by 0 days.

(21) Appl. No.: 13/741,588

(22) Filed: Jan. 15, 2013

(65) Prior Publication Data

US 2014/0199119 A1 Jul. 17, 2014

(51) Int. Cl.
*E01C 9/08* (2006.01)

(52) U.S. Cl.
CPC ..... *E01C 9/08* (2013.01)
USPC ..... 405/39

(58) Field of Classification Search
USPC ..... 404/34, 35, 36, 39, 40, 41, 46; 238/14
See application file for complete search history.

(56) References Cited

U.S. PATENT DOCUMENTS

| | | | | | |
|---|---|---|---|---|---|
| 140,835 | A | | 7/1873 | Kilburn | |
| 1,939,528 | A | * | 12/1933 | Swift | 52/448 |
| 3,099,051 | A | * | 7/1963 | Chenoweth | 403/402 |
| 3,500,606 | A | * | 3/1970 | Wharmby | 52/591.1 |
| 3,851,989 | A | | 12/1974 | Peach | |
| 3,856,145 | A | * | 12/1974 | Bartholomew | 211/40 |
| 4,964,751 | A | * | 10/1990 | Rope et al. | 404/35 |
| 5,482,396 | A | * | 1/1996 | Guillemet | 403/401 |
| 6,089,784 | A | * | 7/2000 | Ardern | 404/41 |
| 6,141,882 | A | * | 11/2000 | Syken | 33/471 |
| 6,802,168 | B1 | * | 10/2004 | Minnick | 52/592.1 |
| 6,817,150 | B1 | * | 11/2004 | Boeshart | 52/309.6 |
| 6,966,161 | B2 | * | 11/2005 | Palsson et al. | 52/589.1 |
| 7,025,530 | B2 | | 4/2006 | Beamish et al. | |
| 7,160,055 | B2 | | 1/2007 | Beamish et al. | |
| 7,604,431 | B2 | | 10/2009 | Fournier | |
| 7,677,832 | B2 | * | 3/2010 | Yee | 404/40 |
| 7,934,885 | B2 | | 5/2011 | Fournier | |
| 8,015,772 | B2 | * | 9/2011 | Jensen | 52/574 |
| 8,096,728 | B2 | | 1/2012 | Stasiewich et al. | |
| 2004/0175233 | A1 | | 9/2004 | Beamish et al. | |
| 2006/0115327 | A1 | | 6/2006 | Beamish et al. | |
| 2008/0075533 | A1 | | 3/2008 | Fournier | |
| 2009/0087261 | A1 | | 4/2009 | Fournier | |
| 2009/0297266 | A1 | * | 12/2009 | Stasiewich et al. | 404/36 |
| 2010/0209187 | A1 | | 8/2010 | Relland et al. | |
| 2011/0299923 | A1 | | 12/2011 | Bleile et al. | |
| 2012/0060438 | A1 | * | 3/2012 | Jensen | 52/438 |
| 2012/0087725 | A1 | | 4/2012 | Bathelt | |
| 2012/0174522 | A1 | * | 7/2012 | Gregor | 52/651.01 |
| 2013/0093185 | A1 | * | 4/2013 | Coeffe et al. | 285/332 |

* cited by examiner

*Primary Examiner* — Thomas B Will
*Assistant Examiner* — Jessica H Lutz
(74) *Attorney, Agent, or Firm* — Antoinette M. Tease

(57) ABSTRACT

A rig mat comprising a downwardly sloping first end comprising a female coupling and extending across a first lateral end of the rig mat and an upwardly sloping second end comprising a male coupling and extending across a second lateral end of the rig mat. Each of the downwardly sloping first end and upwardly sloping second end is in the form of a triangle comprising three angles that total one hundred eighty degrees. The downwardly sloping first end comprises a sloped flat surface and a bottom surface that is level with a bottom surface of the rig mat. The upwardly sloping second end comprises a sloped flat surface and a top surface that is level with a top surface of the rig mat.

14 Claims, 16 Drawing Sheets

INTERLOCKING RIG MATS

BACKGROUND OF THE INVENTION

1. Field of the Invention

The present invention relates generally to the field of rig mats, and more specifically, to a rig mat with an interlocking mechanism that is superior to prior art because it prevents the accumulation of dirt, debris and frozen matter, has no parts that are easily bent or broken, and does not require manual assembly.

2. Description of the Related Art

Existing interlocking rig mat designs such as those described in U.S. Pat. No. 8,096,728 (Stasiewich et al., 2012), U.S. Patent Application Pub. No. 2011/0299923 (Bleile et al.) and U.S. Patent Application Pub. No. 2012/0087725 (Bathelt) are inferior because they allow dirt, debris and frozen matter such as snow and ice to accumulate within the interlocking mechanism itself. It is both difficult and time-consuming to clean out the interlocking mechanism, which leads to increased operational costs. Furthermore, existing rig mat designs are constructed with parts that are easily damaged or bent. Some rig mats (examples of which are discussed below) contain parts or pins that must be twisted or inserted as the mats are laid down.

A primary object of the present invention is to provide an interlock system that is self-cleaning and that does not include any parts that can be damaged or bent. A further object of the present invention is to provide an interlocking rig mat assembly that does not require the manual manipulation of parts and that can be easily assembled in the field.

Discussed below are several additional examples of road or ground mats with configurations that are structurally dissimilar to the present invention. As far as the inventors are aware, there are no prior art examples of rig mats that are structurally similar to the present invention.

U.S. Pat. No. 140,835 (Kilburn, 1873) provides a pavement mat with beveled ends for placing the mats end-to-end and stacking the end of one mat on top of the end of another mat, such that the mats lie flat to create an extended flat surface. This invention does not include any mechanism by which the mats are actually locked together.

U.S. Pat. No. 3,851,989 (Peach, 1974) discloses an expansion joint for slabs of concrete roadways. Each end of the slab has a sloped end that corresponds to the sloped end of the adjacent slab so that the end of one slab can be stacked on top of the end of another slab. The space between the sloped ends is sealed with hot asphalt. As with the previous patent, there is no mechanism for locking the concrete slabs together.

U.S. Pat. No. 7,025,530 (Beamish et al., 2006) and U.S. Pat. No. 7,160,055 (Beamish et al., 2007) both describe a road mat with a locking mechanism on either end of the mat. The locking mechanism consists of a male coupling and a female coupling on both ends of the mat. The female coupling is in the shape of a convex tube that extends along the entire width of the mat (either continuously or discontinuously and the male coupling is in the shape of a concave tube that extends along the entire width of the mat, such that the female coupling fits inside of the male coupling. The locking mechanism also includes supporting alignment plates that are situated between the female couplings on the ends of adjacent mats. This invention is problematic because its configuration allows dirt, debris and frozen matter to accumulate inside of the female couplings, and the male and female couplings are exposed to forces that may cause them to bend or break.

U.S. Pat. No. 7,604,431 (Fournier, 2009) provides an interlocking ground cover mat in which the ends of the mats are joined together with a retaining pin that feeds through openings in perpendicular plates. In an alternate embodiment, the ends of the mats are joined together by complementary pins and recesses. Both embodiments require the manual insertion of pins, and they present recesses in which dirt, debris and frozen matter may accumulate.

U.S. Pat. No. 7,934,885 (Fournier, 2011) discloses an interlocking ground cover mat similar in that described in U.S. Pat. No. 7,604,431 except that the ends of the mats incorporate an I-beam on one end and a tubular member on the other end. The tubular members fit inside of the I-beams, thereby securing the mats together. The ends of the tubular members are modified to facilitate insertion of a sling for lifting one or more mats and also to facilitate stacking of adjacent mats. This design suffers from the same disadvantages as the '431 patent.

U.S. Patent Application Pub. No. 2010/0200187 (Rolland et al.) describes an interlocking mat system in which the end of one mat slides laterally onto the end of another mat. The interlocking ends of the mats are comprised of tubular members formed of steel pipe with slots in them for slidably receiving a key on the end of an adjacent mat. This particular invention is difficult to assemble because each mat must be carefully and precisely slid sideways onto an adjacent mat. The keys are also vulnerable to being damaged in the process.

None of the above mat systems provides the advantages of the present invention, namely: (a) the automatic prevention of buildup of dirt, debris and frozen matter within the interlocking mechanism; (b) the elimination of any parts that can be damaged or bent during installation or use of the mat; and (c) the omission of any components that require manual manipulation in connection with installation or use of the mat. Furthermore, unlike the present invention, the prior art rigs mats discussed above require a separate ramp to be placed onto the end of the mat in order to drive a vehicle up onto the mat; this disadvantage is overcome by the present invention. These and other structural features of the present invention are discussed more fully below.

BRIEF SUMMARY OF THE INVENTION

The present invention is a rig mat comprising: a downwardly sloping first end comprising a female coupling and extending across a first lateral end of the rig mat; an upwardly sloping second end comprising a male coupling and extending across a second lateral end of the rig mat; wherein each of the downwardly sloping first end and upwardly sloping second end is in the form of a triangle comprising three angles that total one hundred eighty degrees; wherein the downwardly sloping first end comprises a sloped flat surface and a bottom surface that is level with a bottom surface of the rig mat; and wherein the upwardly sloping second end comprises a sloped flat surface and a top surface that is level with a top surface of the rig mat.

In a preferred embodiment, the female coupling is a key slot. Preferably, there are no openings on the downwardly sloping first end of the rig mat other than the key slot, the key slot opens into a chamber bordered by a rear wall and two side walls, and the chamber has no floor. The key slot preferably comprises a top portion and a bottom portion, and the top portion is wider than the bottom portion. The downwardly sloping first end has a center, and the female coupling is preferably located in the center of the downwardly sloping first end.

In a preferred embodiment, the male coupling is a truck hitch ball. Preferably, the truck hitch ball is attached to a metal plate that is recessed into the upwardly sloping second end of the rig mat. The upwardly sloping second end of the rig mat has a vertical axis and a horizontal axis, and the truck hitch ball preferably does not extend beyond the vertical or horizontal axis of the upwardly sloping second end of the rig mat. Preferably, the upwardly sloping second end is completely closed to an environment outside of the upwardly sloping second end. The upwardly sloping second end has a center, and the male coupling is preferably located in the center of the upwardly sloping second end.

In a preferred embodiment, the downwardly sloping first end of the rig mat comprises two lateral ends, and each lateral end of the downwardly sloping first end is covered by an end plate. In another preferred embodiment, the upwardly sloping second end of the rig mat comprises two lateral ends, and each lateral end of the upwardly sloping second end is covered by an end plate. In yet another preferred embodiment, the rig mat further comprises a metal frame with two longitudinal side members, and the end plates are integral with the longitudinal side members of the metal frame.

In a preferred embodiment, the upwardly sloping second end is in the form of a triangle comprised of two forty-five-degree angles and one ninety-degree angle. In another preferred embodiment, the downwardly sloping second end is in the form of a triangle comprised of two forty-five-degree angles and one ninety-degree angle.

In a preferred embodiment, the rig mat further comprises a metal frame and a cross-laminated timber core; wherein the cross-laminated timber core is positioned inside of the metal frame; and wherein the downwardly sloping first end is attached to a first lateral end of the metal frame, and the upwardly sloping second end is attached to a second lateral end of the metal frame.

REFERENCE NUMBERS

1 Rig mat
1*a* Downwardly sloping first end
1*b* Upwardly sloping second end
1*c* Top edge (of upwardly sloping second end)
1*d* Bottom surface (of downwardly sloping first end)
1*e* Sloped flat surface (of downwardly sloping first end)
1*f* Top surface (of upwardly sloping second end)
1*g* Sloped flat surface (of upwardly sloping second end)
2 Key slot
2*a* Key slot chamber
2*b* Side wall (of key slot chamber)
3 Truck hitch ball
3*a* Recessed plate (in upwardly sloping second end)
4 Pin
4*a* Hole
5 Metal plate (surrounding pin)
6 Metal frame
6*a* Outer wall (of metal frame)
7 Wood core
8 Lifting ring
9 End plate
10 Longitudinal side member (of metal frame)
11 Well
12 Metal plate (recessed in well)

DETAILED DESCRIPTION OF INVENTION

Figure 1A:
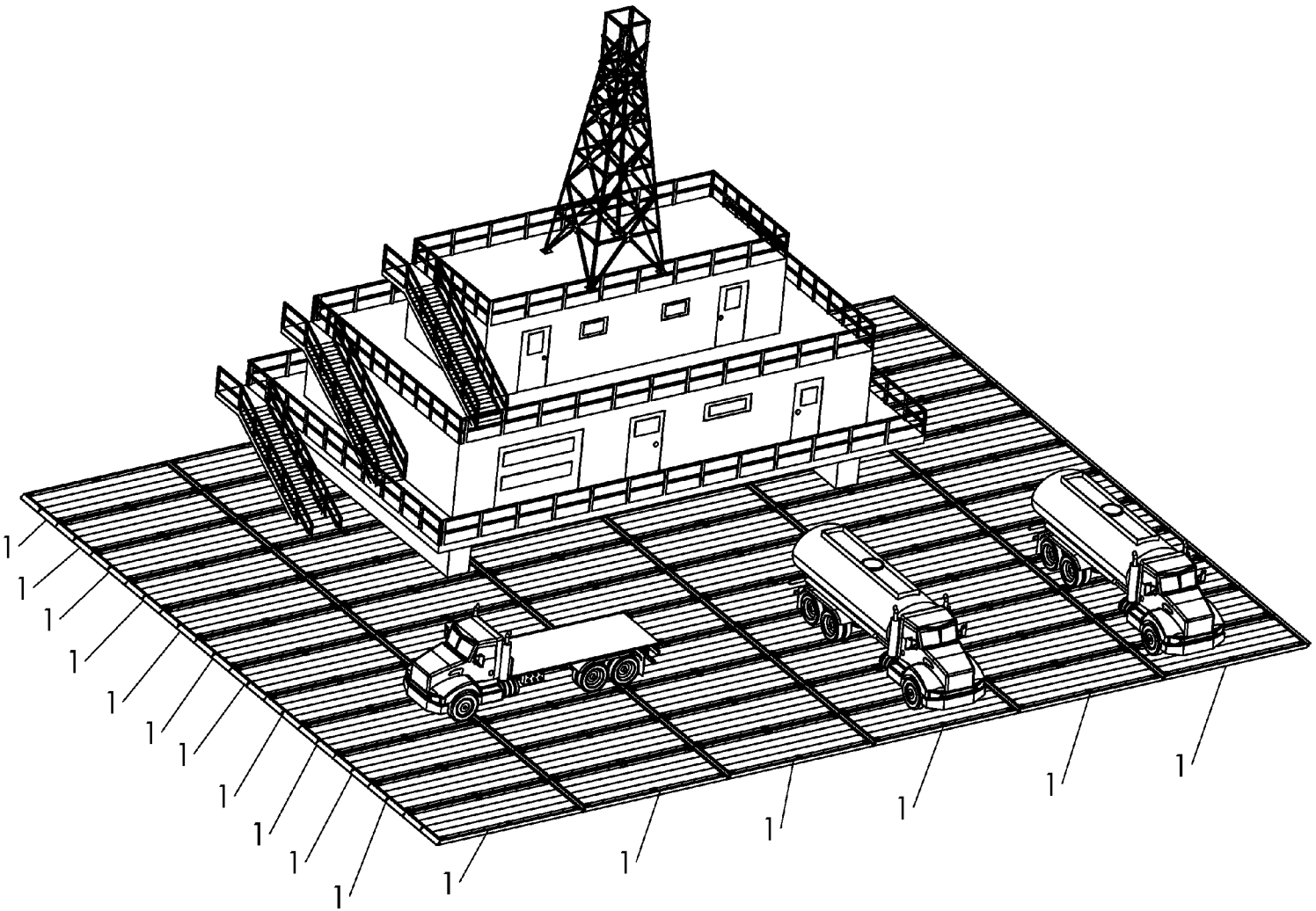
FIG. 1A is a perspective view of an assembly of rig mats of the present invention shown fully installed on a pad site.
Figure 1B:
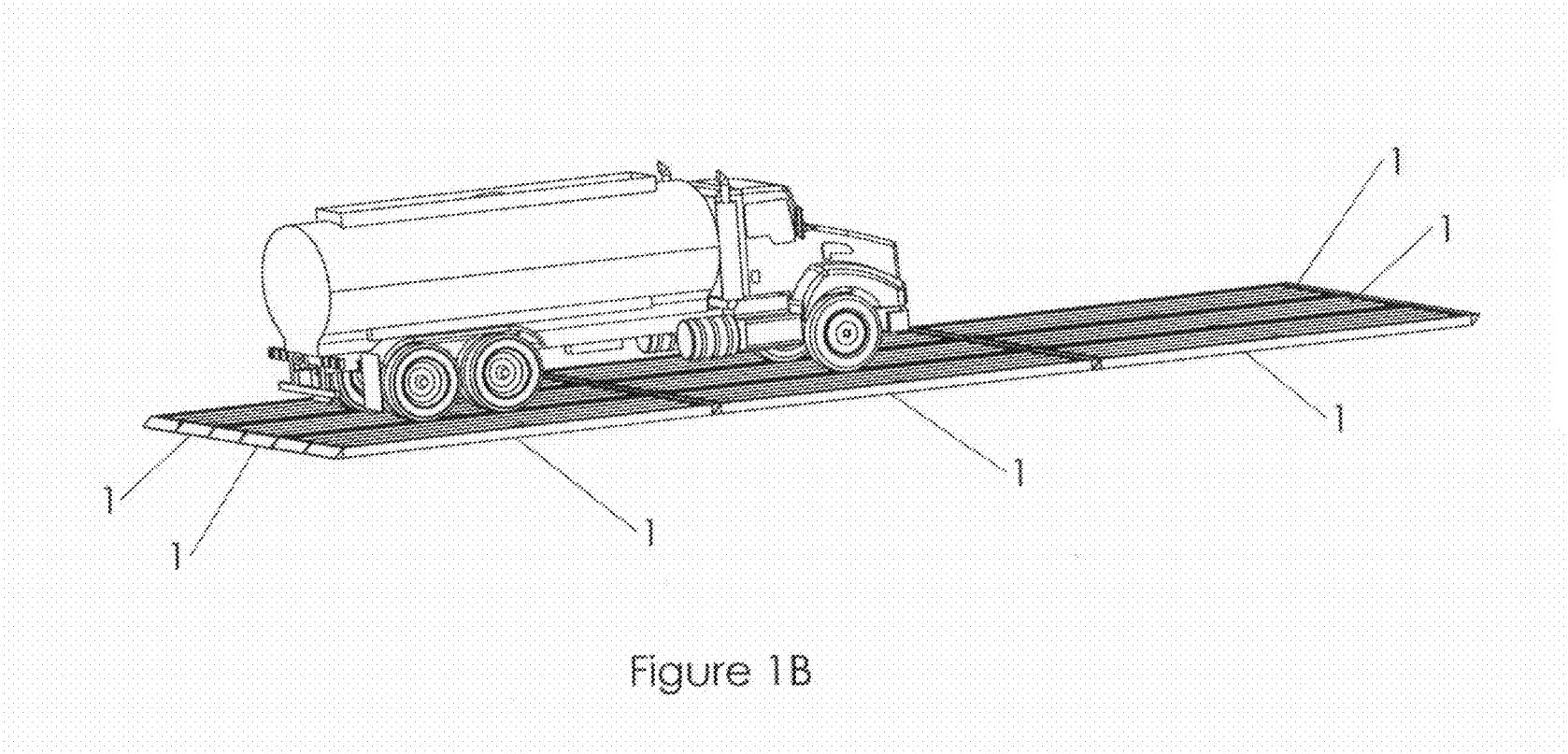
FIG. 1B is a perspective view of a vehicle on an assembly of rig mats of the present invention.

FIG. 1A is a perspective view of an assembly of rig mats of the present invention shown fully installed on a pad site. FIG. 1B is a perspective view of a vehicle on an assembly of rig mats of the present invention. As shown in these figures, the rig mats 1 of the present invention can be assembled and locked end-to-end to form a pad site, roadway or other hard surface above the ground. Cut-outs (not shown) may be made in the rig mats for cabling, drainage or any other purpose that requires a conduit to the ground. As shown more clearly in subsequent figures, a novel aspect of the present invention is that one end of each rig mat forms a ramp to allow vehicular access to the surface formed by the rig mats.

Figure 2:
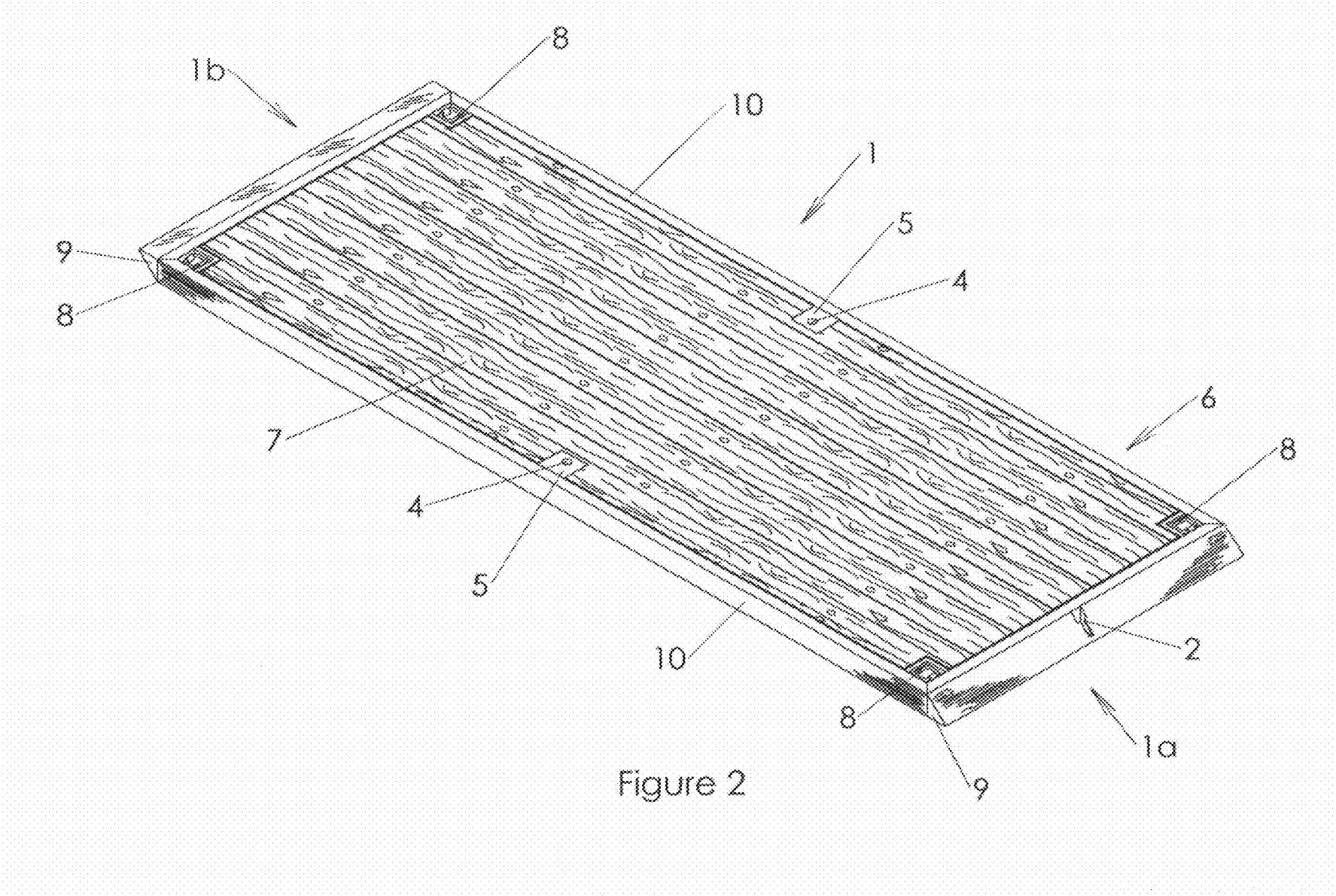
FIG. 2 is a top perspective view of the present invention.

FIG. 2 is a top perspective view of the present invention. As shown in this figure, each rig mat 1 comprise a downwardly sloping first end 1*a* and an upwardly sloping second end 1*b*. The first end 1*a* comprises a female coupling in the form of a key slot 2. The key slot 2 is shown in detail in FIG. 13. The second end 1*b* comprises a male coupling (see FIG. 3) in the form of a truck hitch ball 3. The key slot 2 is preferably located in roughly the center of the first end 1*a*, and the truck hitch ball 3 is preferably located in roughly the center of the second 1*b*, so that when two rigs mats are placed end-to-end, the truck hitch ball 3 fits into the key slot 2 (see FIG. 18).

The rig mat 1 shown in FIG. 2 is twenty (20) feet long, eight (8) feet wide, and six (6) inches high; however, the present invention is not limited to any particular length, width or thickness of the rig mat. In a preferred embodiment, the rig mat 1 comprises one or more pins 4 that extend through metal plates 5 on the top and bottom of the wood core 6 of the rig mat 1. The metal plates 5 are welded to the metal frame 6 (see FIGS. 9 and 10) so that the pins 4 serve to hold the wood core 7 to the metal frame 6. The metal frame 6 also preferably comprises a lifting ring 8 for lifting the rig mat 1 by crane or loader. The lifting rings 8 are shown in greater detail in FIGS. 9 and 10.

Each side (lateral) end of the downwardly sloping first end 1*a* and the upwardly sloping second end 1*b* is covered with an end plate 9 that prevents dirt, debris and frozen matter from getting inside of the first and second ends 1*a*, 1*b*. In a preferred embodiment, the end plates 9 are integral with the longitudinal side members 10 of the metal frame 6. The end plates 9 are preferably welded in the first and second ends 1*a*, 1*b*. As shown in subsequent figures, the upwardly sloping second end 1*b* is completely closed and has no openings to the outer environment. The only opening to the outer environment on the downwardly sloping first end 1*a* is the key slot 2, which opens into a chamber 2*a* bordered by a rear wall 6*a* and two side walls 2*b* (see FIG. 13). This chamber has no floor so that any dirt, debris or frozen matter that is present in the chamber is dislodged and falls through the open (nonexistent) floor when the trunk hitch ball 3 of the male coupling member is inserted into the key slot 2 of the female coupling member. In this manner, the invention automatically ejects accumulated dirt, debris and frozen matter within the key slot chamber. The invention is designed so that there are no other places where dirt, debris and frozen matter can accumulate.

Figure 3:
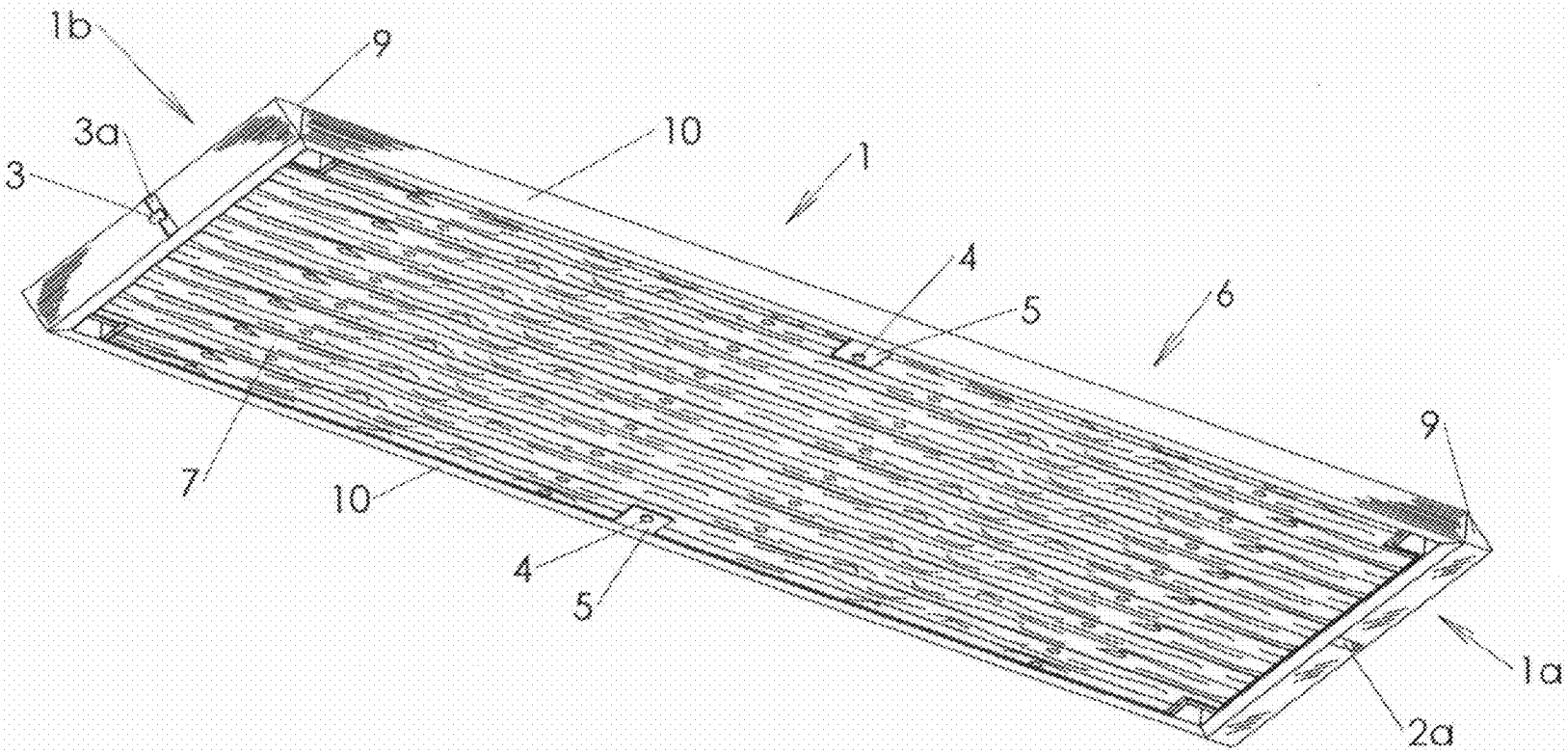
FIG. 3 is a bottom perspective view of the present invention.
Figure 6:
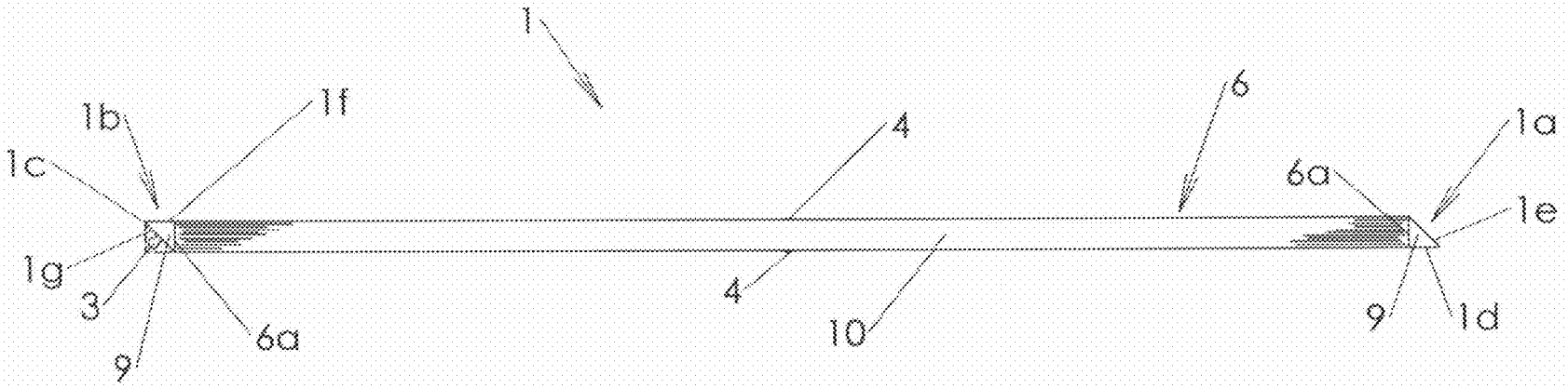
FIG. 6 is a side view of the present invention.
Figure 14:
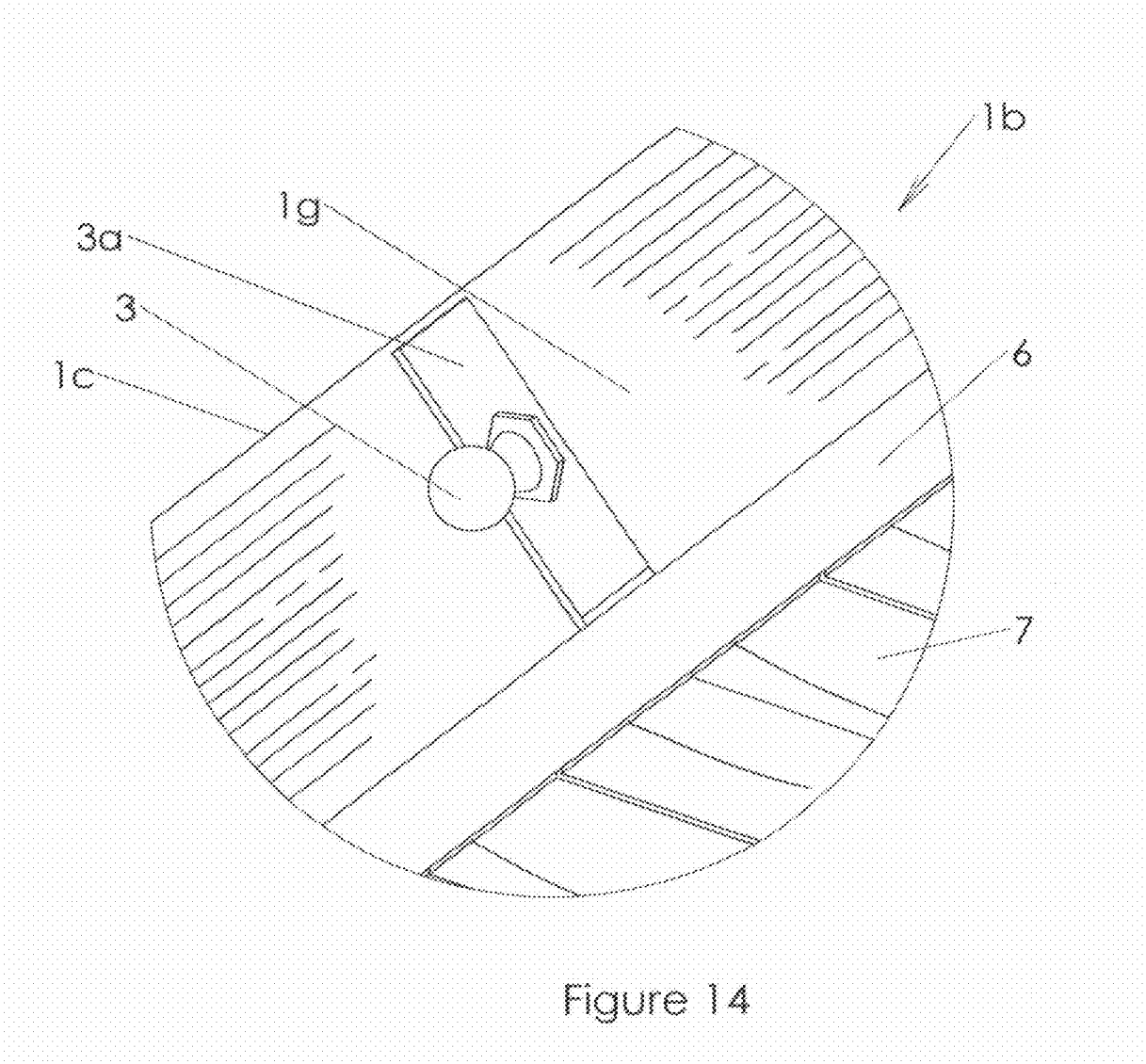
FIG. 14 is a detail view of the male coupling of the present invention.

FIG. 3 is a bottom perspective view of the present invention. This figure shows the open (nonexistent) floor of the key slot chamber 2*a*. It also shows the truck hitch ball 3 that forms the male coupling of the present invention. As shown in FIGS. 6 and 14, the truck hitch ball 3 is preferably attached (bolted) to a metal plate 3*a* that is recessed into the upwardly sloping second end 1*b* of the rig mat 1. The reason the truck hitch ball 3 is attached to a recessed plate 3*a* is so that the ball 3 will not extend beyond the vertical or horizontal axis of the second end 1*b*. This is shown more clearly in FIG. 6. As such, the ball 3 arms not ever come into contact with the ground, and it cannot be broken off because it is protected by the ceiling formed by the upwardly sloping second end 1*b*.

Figure 4:
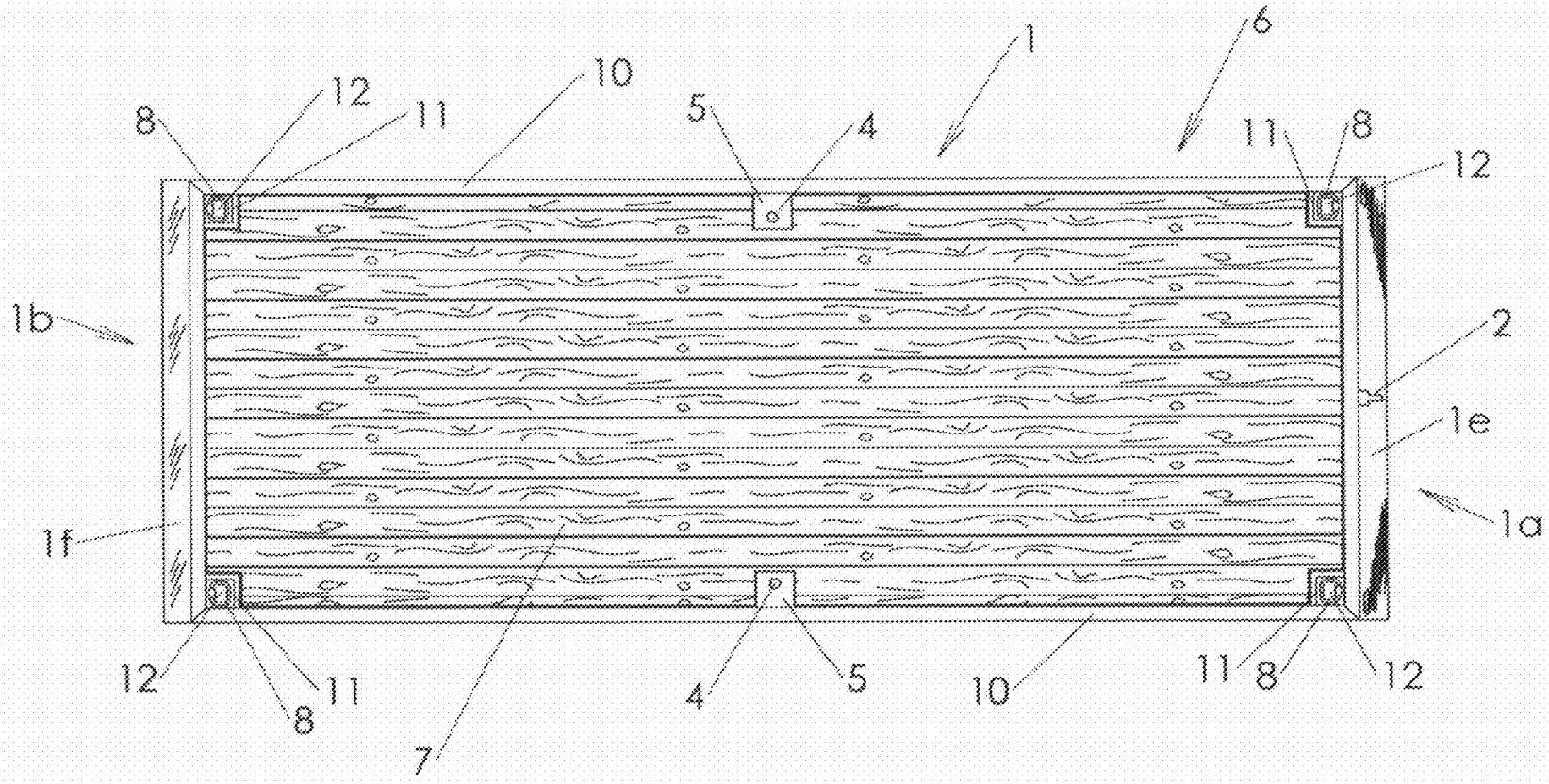
FIG. 4 is a top view of the present invention.

FIG. 4 is a top view of the present invention. This figure shows the same parts as previously described. In this embodiment, the lifting rings 8 are situated within wells 11 created by six-inch-square steel tubing. Each lifting ring 8 is preferably welded to a metal plate 12 that is recessed at an angle the well 11. The reason the lifting rings 8 are attached to recessed metal plates 12 is so that the lifting rings 8 are flush with the top of the rig mat 1 to facilitate stacking of the rig mats 1 for transportation or storage.

Figure 5:
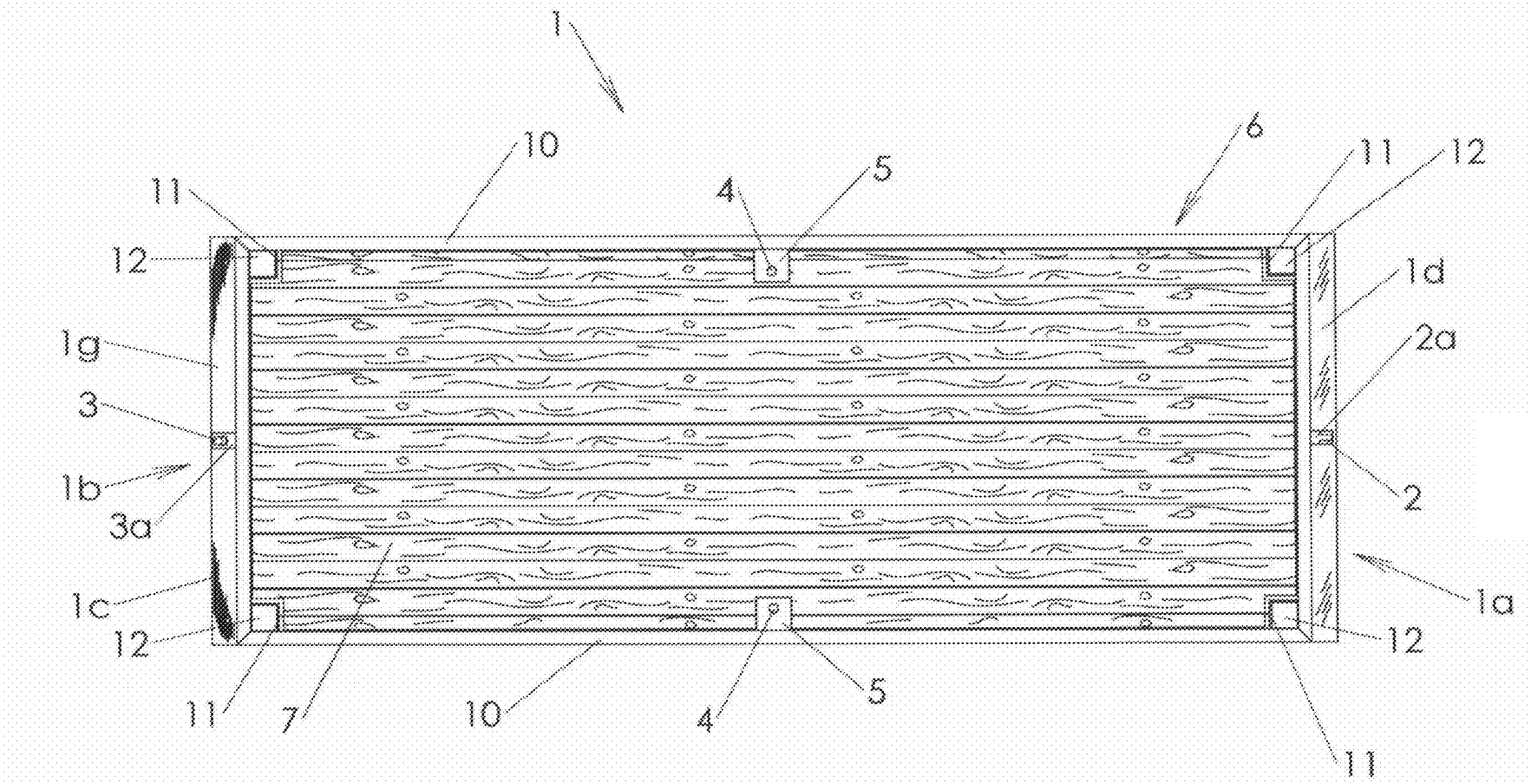
FIG. 5 is a bottom view of the present invention.

FIG. 5 is a bottom view of the present invention. This figure makes it clear that the truck hitch ball 3 does not extend longitudinally beyond the top edge 1*c* of the upwardly sloping second end 1*b* of the rig mat 1. This figure also shows the bottom surface of the recessed metal plates 12 in the wells 11.

FIG. 6 is a side view of the present invention. This figure shows that not only does the truck hitch ball 3 not extend horizontally beyond the top edge 1*c* of the upwardly sloping second end 1*b*, but it also does not extend vertically beyond the bottom edge of the rig mat 1. In this manner, the truck hitch ball 3 is protected from damage. The positioning of the truck hitch ball 3 within the confines of the dotted lines shown in FIG. 6 also ensures that the rig mats can be stacked one on top of another without damaging the truck hitch ball 3.

Figure 6A:
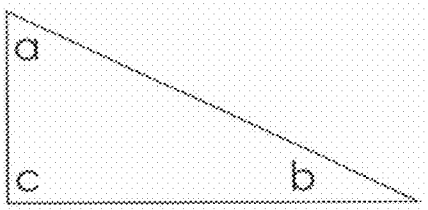
FIG. 6*a* is a detail view of the present invention.

Note also that although the downwardly sloping first end 1*a* and upwardly sloping second end 1*b* are shown are being comprised of two forty-five (45)-degree angles and one ninety (90)-degree angle, these angles can be adjusted to accommodate different requirements. The present invention is not limited to any particular angles, as long as the downwardly sloping first end 1*a* and upwardly sloping second end 1*b* are roughly triangular in shape. (In order to be roughly triangular in shape, the three angles a, b, c comprising the triangle must add up to one hundred eighty degrees; see FIG. 6A). This triangular shape is preferably formed in each case by the outer wall 6*a* of the metal frame 6 and a single piece of bent metal that comprises, in the case of the downwardly sloping first end 1*a*, the bottom surface 1*d* and sloped flat surface 1*e*, and in the case of the upwardly sloping second end 1*b*, the top surface 1*f* and sloped flat surface 1*g*.

Figure 7:
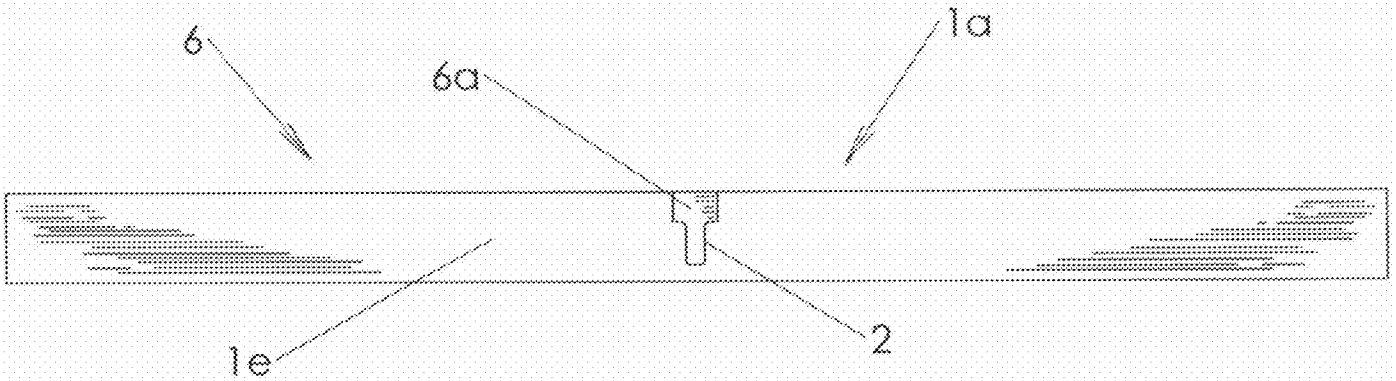
FIG. 7 is a first end view of the present invention showing the female coupling of the present invention.
Figure 8:
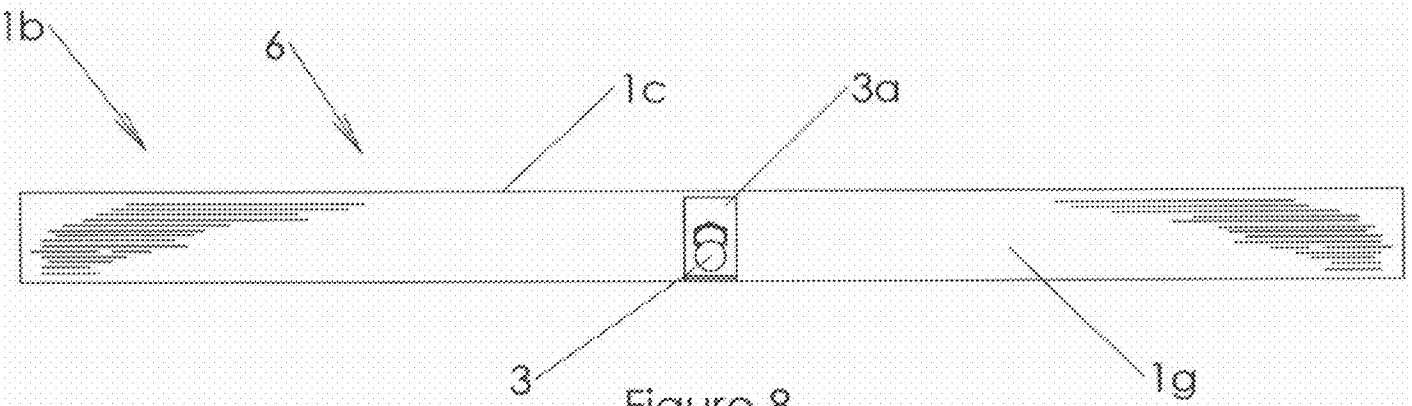
FIG. 8 is a second end view of the present invention showing the male coupling of the present invention.

FIG. 7 is a first end view of the present invention showing the female coupling of the present invention, and FIG. 8 is a second end view of the present invention showing the male coupling of the present invention. FIG. 8 also shows that the truck hitch ball 3 does not come into contact with the ground when the rig mat 1 is laid flat on the ground. This is because of the recessed metal plate 3*a*, which ensures that the truck hitch ball 3 does not extend horizontally beyond the top edge 1*c* of the upwardly sloping second end 1*b* or vertically beyond the bottom surface of the rig mat. Note that the bottom surface of the rig mat is on the same horizontal plane as (i.e., level with) the bottom surface 1*d* of the downwardly sloping first end 1*a*. Similarly, the top surface of the rig mat is on the same horizontal plane as (i.e., level with) the top surface 1*f* of the upwardly sloping second end.)

Figure 9:
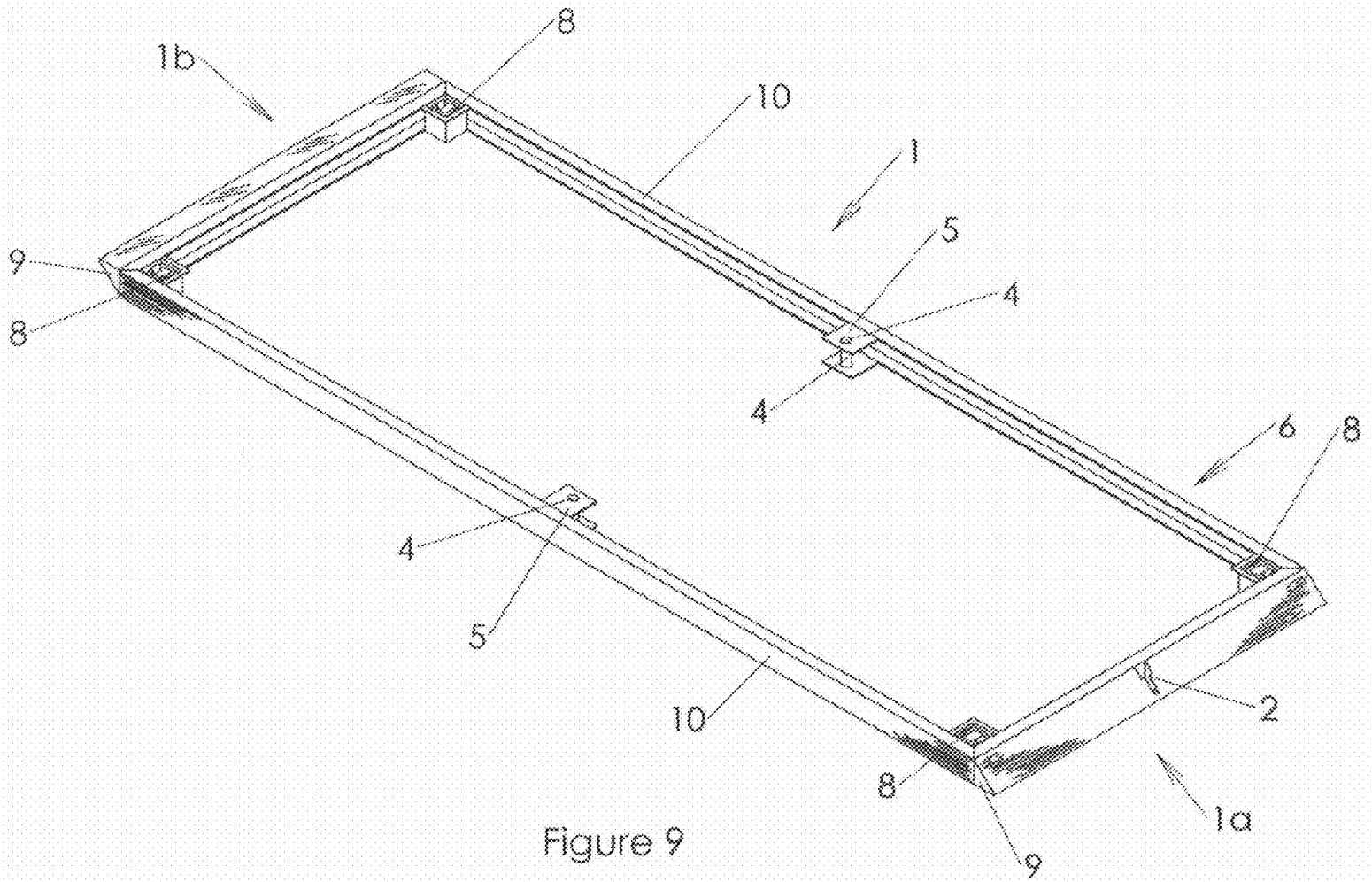
FIG. 9 is a top perspective view of the frame of the present invention.
Figure 10:
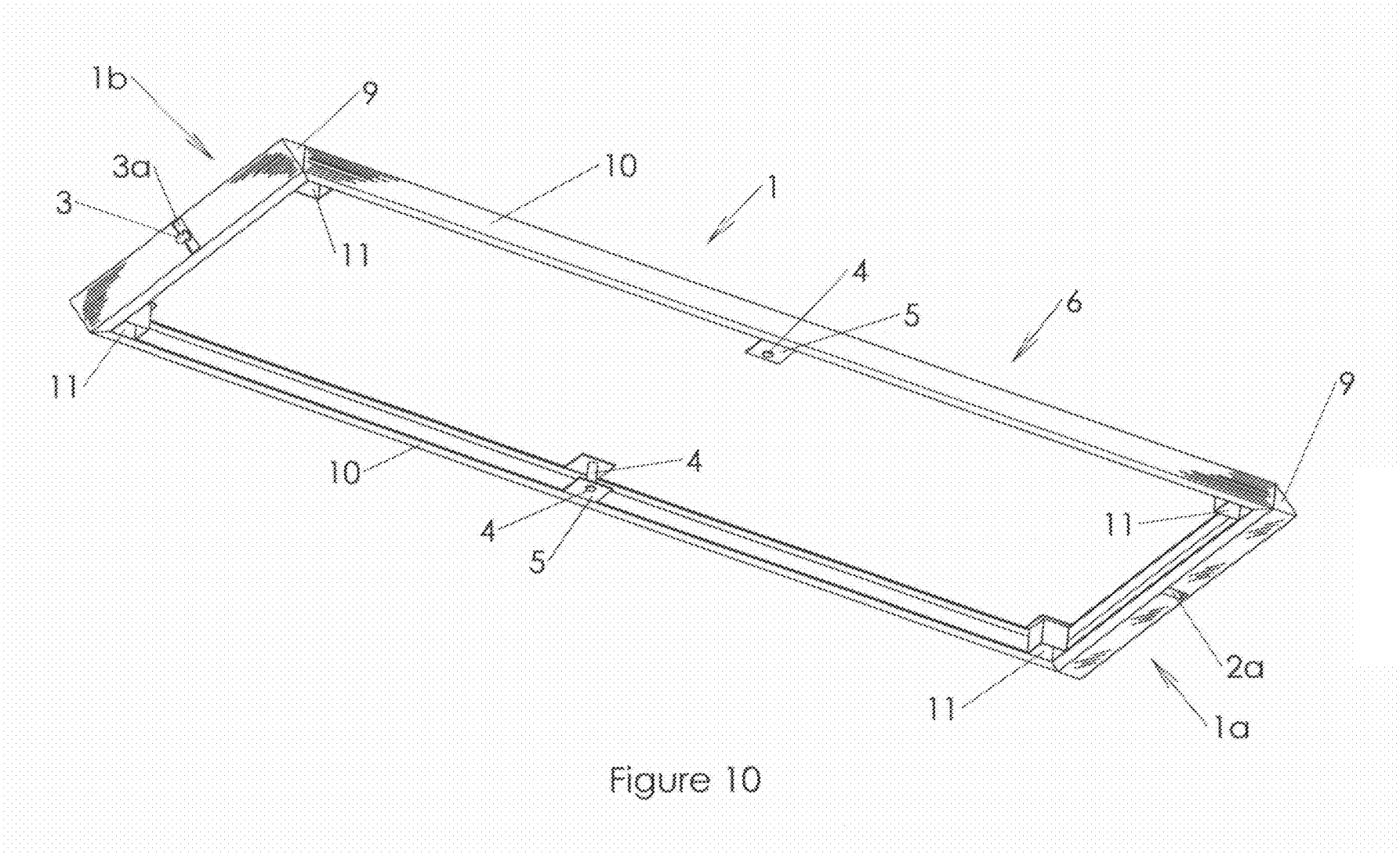
FIG. 10 is a bottom perspective view of the frame of the present invention.

FIG. 9 is a top perspective view of the frame of the present invention, and FIG. 10 is a bottom perspective view of the frame of the present invention. The parts shown in these two figures have been previously described.

Figure 11:
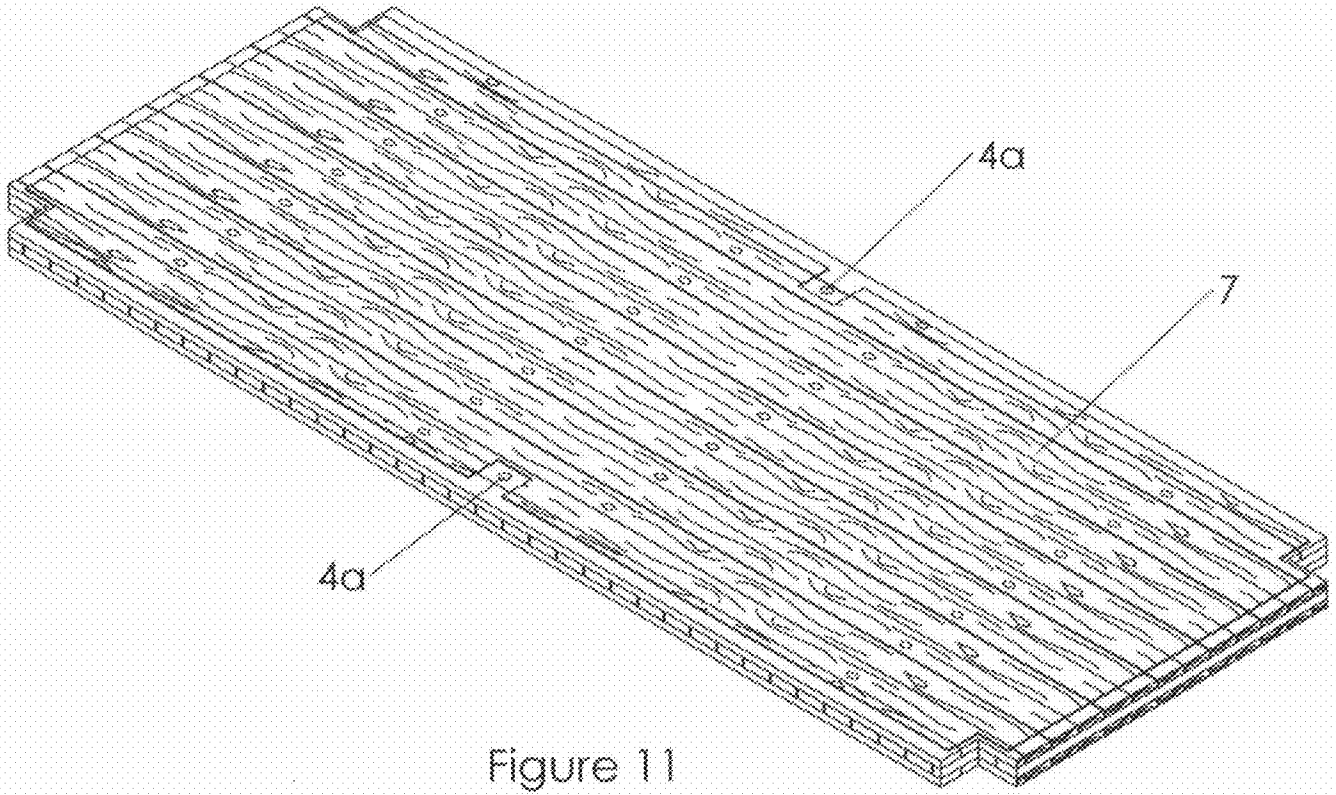
FIG. 11 is a top perspective view of the cross-laminated timber core of the present invention.
Figure 12:
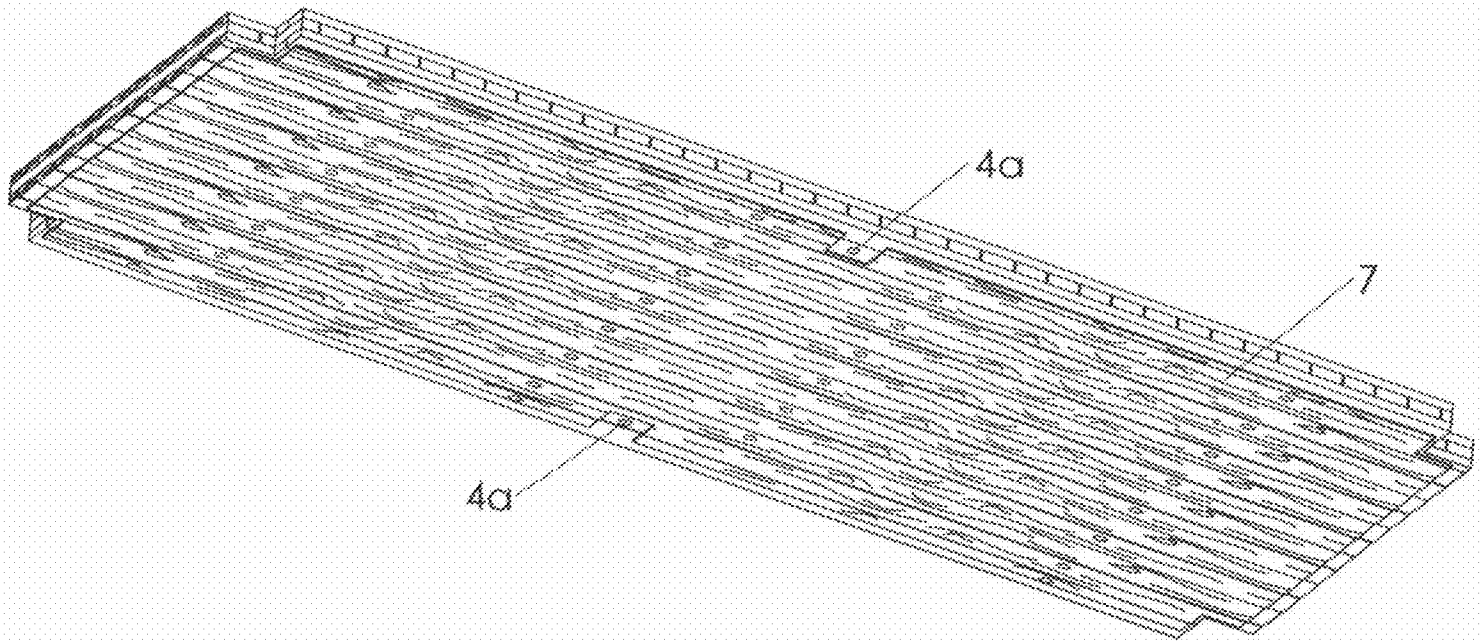
FIG. 12 is a bottom perspective view of the cross-laminated timber core of the present invention.

FIG. 11 is a top perspective view of the cross-laminated timber core of the present invention, and FIG. 12 is a bottom perspective view of the cross-laminated timber core of the present invention. The cross-laminated timber core contributes strength to the overall structure and ensures that the metal frame 6 will not be bent or twisted during installation or use and that undue pressure will not be placed on the welded seams of the metal frame 6 (or the weld between the first and second ends 1*a*, 1*b* and the metal frame 6). Although FIGS. 11 and 12 each shows two holes 4*a* for the pins 4 (not shown), the present invention is not limited to any particular number of location of pins 4, and the pins 4 and metal plates 5 (not shown) are optional.

Figure 13:
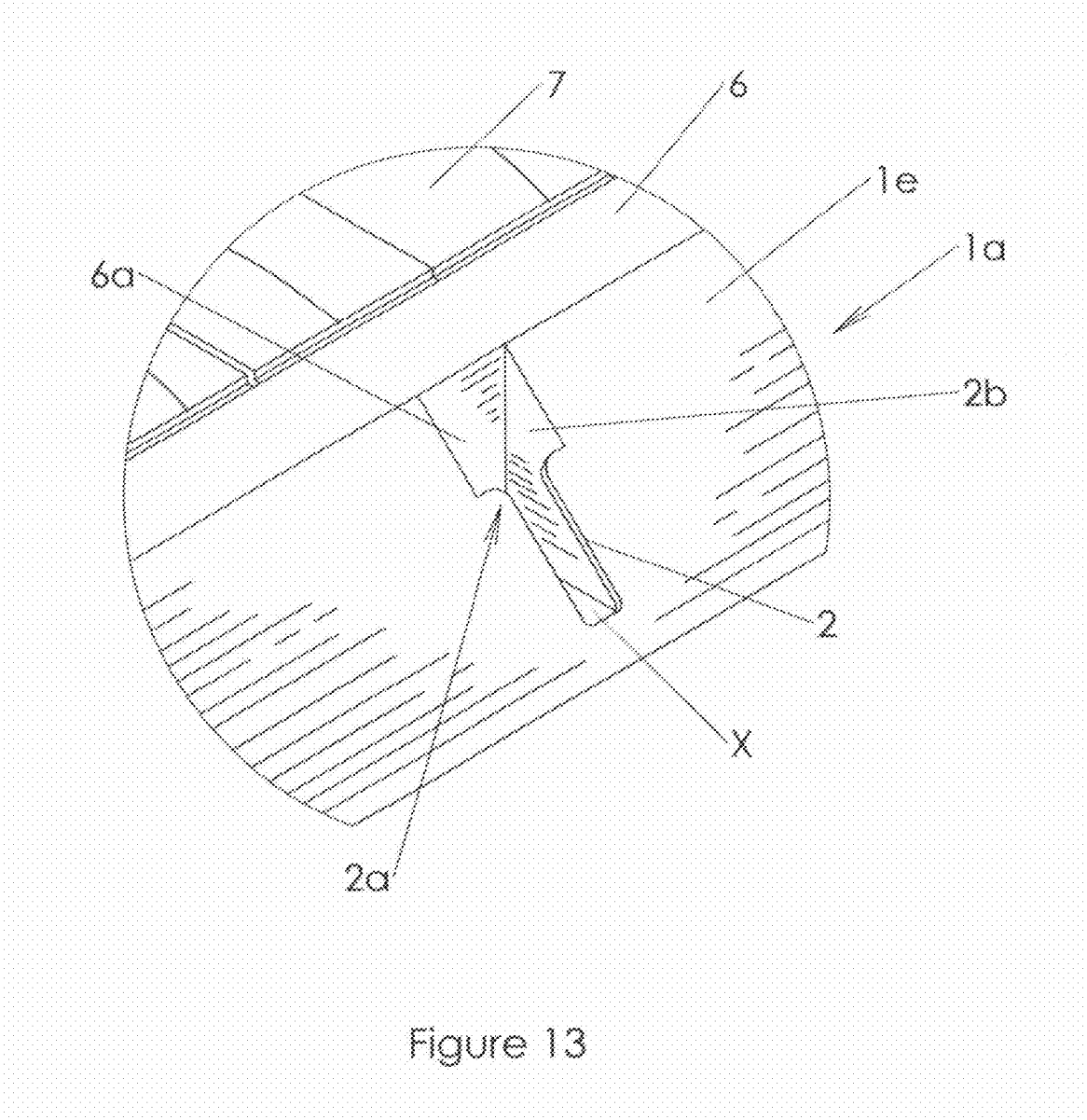
FIG. 13 is a detail view of the female coupling of the present invention.

FIG. 13 is a detail view of the female coupling of the present invention. This figure shows the one of the two side walls 2*a* of the key slot compartment 2*a*. The door (designated with an "X" in FIG. 13) of the key slot compartment 2*a* is open to the ground. The key slot 2 preferably comprises a top portion that is wider than the bottom portion.

FIG. 14 is a detail view of the male coupling of the present invention. The structural features of the male coupling have been described above.

Figure 16:
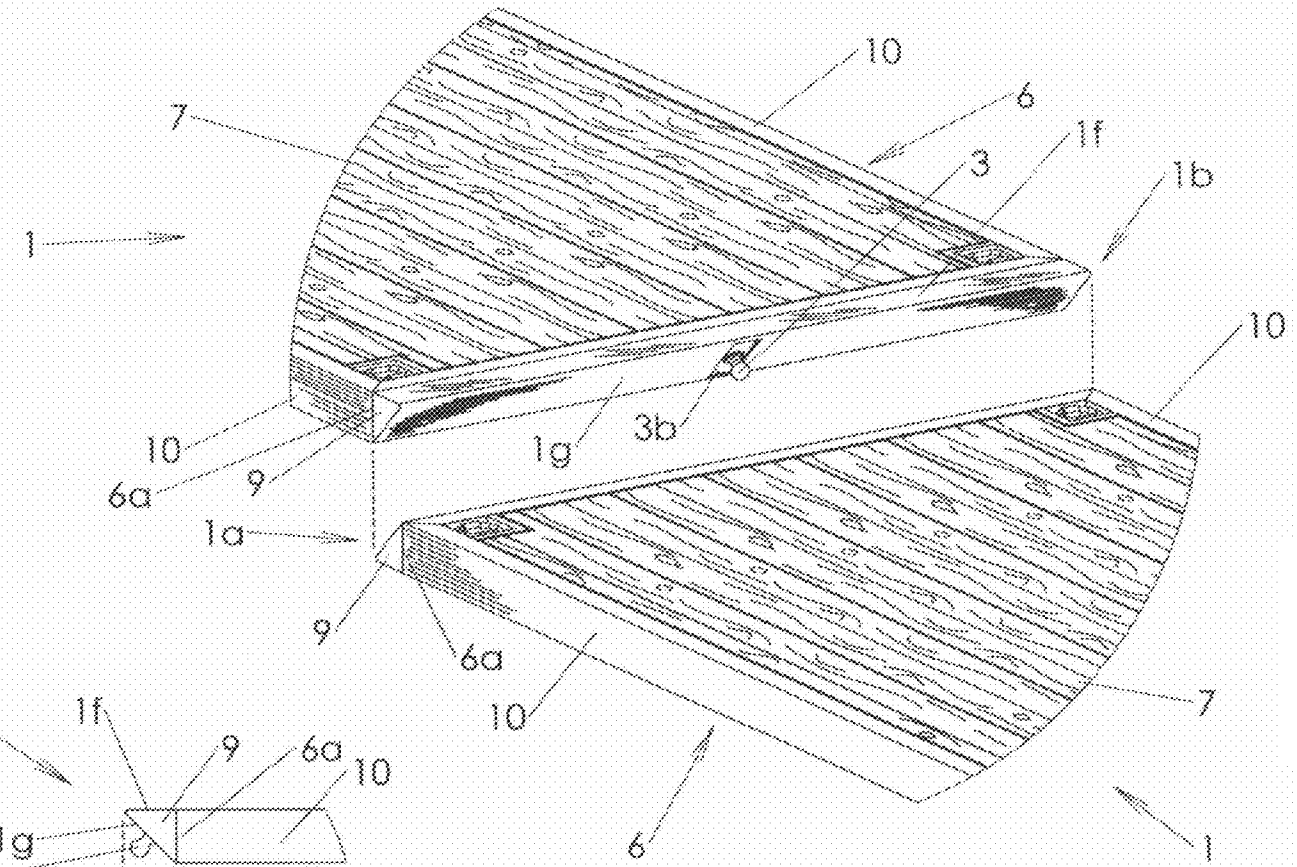
FIG. 16 is a partial side view of two rig mats of the present invention illustrating how they are positioned immediately prior to locking.
Figure 15:
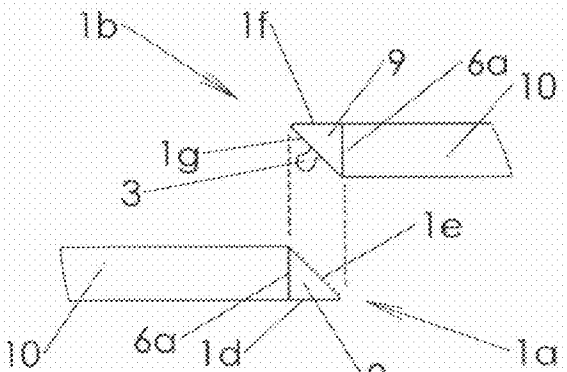
FIG. 15 is a partial perspective view of two rig mats of the present invention illustrating how they are positioned immediately prior to locking.

FIG. 15 is a partial perspective view of two rig mats of the present invention illustrating how they are positioned immediately prior to locking, and FIG. 16 is a partial side view of two rig mats of the present invention illustrating how they are positioned immediately prior to locking. As shown in these figures, the truck hitch ball 3 is positioned directly above the key slot 2 (not shown) and is slid down and into the key slot, from the wider top portion of the key slot to the narrower bottom portion of the key slot (see FIG. 13). The weight of the upper rig mat 1 (that is, the one with the truck hitch ball 3) pushes the truck hitch ball 3 down into the narrower bottom portion of the key slot 2, which locks the upper rig mat 1 into position and prevents it from becoming dislodged. The round shape of the truck hitch ball 3, however, allows for slight rotational movement of the upper rig mat 1 inside the key slot 2. This in turn allows the rig mats 1 to move slightly to accommodate uneven terrain or to provide for slightly non-linear orientation (e.g., twisting to accommodate the lay of the land), if desired.

Figure 18:
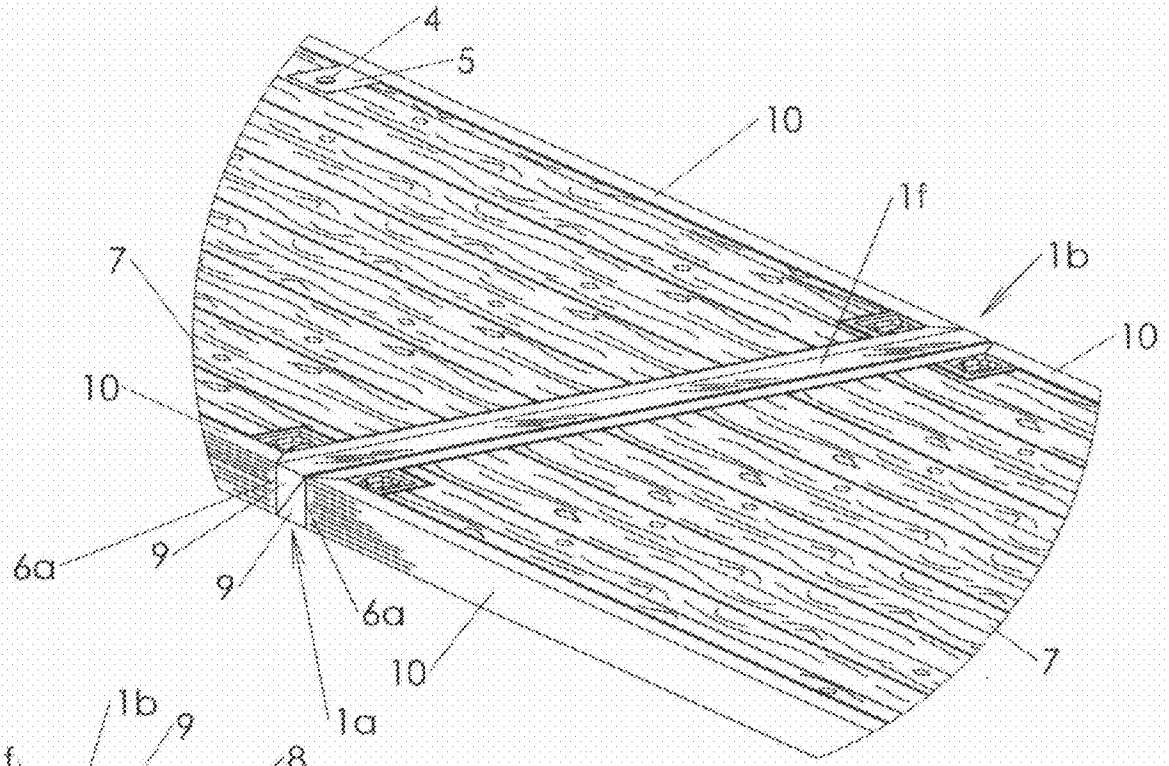
FIG. 18 is a partial section view of two rig mats of the present invention shown in a locked position.
Figure 17:
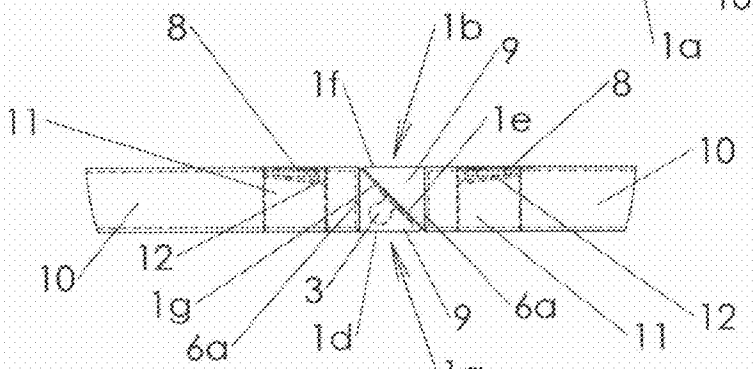
FIG. 17 is a partial perspective view of two rigs mats of the present invention shown in a locked position.

FIG. 17 is a partial perspective view of two rigs mats of the present invention shown in a locked position, and FIG. 18 is a partial section view of two rig mats of the present invention shown in a locked position. As shown in these figures, the adjacent rig mats 1 create a continuous planar surface when locked together. Other types of rig mats have steel parts on the ends of the rig mats that bend or cause tire punctures when trucks drive over them. The present invention overcomes this disadvantage in the prior art.

In addition, when the rig mats 1 are locked together, the weight of the upper rig mat is distributed evenly along the entire surface of the downwardly sloping first end 1*a* of the lower rig mat; in other words, there is steel on steel across the entire lateral end of the rig mat. This avoids placing undue wear and tear on any one component of the rig mat.

To unlock the rig mats, the upper rig mat 1 must be lifted upward and sideways until the truck hitch ball 3 can be lifted out of the key slot 2; thus, the present invention makes it virtually impossible for the rig mats 1 to come apart unless they are intentionally pulled apart (because some force would need to be applied to pull the upper rig mat upward and sideways along the downwardly sloped first end 1*a* of the lower rig mat).

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A system of interlocking rig mats, each rig mat comprising:

(a) a downwardly sloping first lateral end comprising a female coupling and extending across the first lateral end of the rig mat;

(b) an upwardly sloping second lateral end comprising a male coupling and extending across the second lateral end of the rig mat;

(c) a metal frame and a cross-laminated timber core, wherein the cross-laminated timber core is positioned inside of the metal frame, and wherein the downwardly sloping first lateral end is attached to a first lateral end of the metal frame, and the upwardly sloping second lateral end is attached to a second lateral end of the metal frame; and wherein each of the downwardly sloping first lateral end and upwardly sloping second lateral end is in the form of a triangle comprising three angles that total one hundred eighty degrees;

wherein the downwardly sloping first lateral end comprises a sloped flat surface and a bottom surface that is level with a bottom surface of the rig mat; and wherein the upwardly sloping second lateral end comprises a sloped fiat surface and a top surface that is level with the top surface of the rig mat;

wherein adjacent rig mats are configured to lock together laterally, and the weight of one rig mat is distributed evenly along the entire surface of the downwardly sloping first lateral end of an adjacent rig mat when the rig mats are locked together;

wherein the adjacent rig mats are configured to allow rotational movement of one rig mat relative to an adjacent rig mat when the rig mats are locked together;

wherein the adjacent rig mats create a continuous planar surface when locked together;

wherein the downwardly sloping first lateral end is configured to form a ramp to allow vehicular access to the continuous planar surface;

wherein the female coupling is a key slot comprising a top portion and a bottom portion, and the top portion is wider than the bottom portion;

wherein the male coupling is a truck hitch ball; and wherein to assemble the system of interlocking rig mats, the truck hitch ball of a first rig mat is positioned directly above the key slot of a second rig mat and slid down and into the key slot, from the top portion of the key slot to the bottom portion of the key slot, wherein the first rig mat has a certain weight, and wherein the weight of the first rig mat pushes the truck hitch ball down into the bottom portion of the key slot, thereby locking the first rig mat into position and preventing it from becoming disclosed.

2. The system of interlocking rig mats of claim 1, wherein there are no openings on the downwardly sloping first lateral end of the rig mat other than the key slot, wherein the key slot opens into a chamber bordered by a rear wall and two side walls, and wherein the chamber has no floor.

3. The system of interlocking rig mats of claim 1, wherein the downwardly sloping first lateral end has a center, and the female coupling is located at the center of the downwardly sloping first lateral end.

4. The system of interlocking rig mats of claim 1, wherein the truck hitch ball is attached to a metal plate that is recessed into the upwardly sloping second lateral end of the rig mat.

5. The system of interlocking rig mats of claim 1, wherein the upwardly sloping second lateral end of the rig mat has a vertical axis and a horizontal axis, and the truck hitch ball does not extend beyond the vertical or horizontal axis of the upwardly sloping second lateral end of the rig mat.

6. The system of interlocking rig mats of claim 1, wherein the upwardly sloping second lateral end is completely closed to an environment outside of the upwardly sloping second end.

7. The system of interlocking rig mats of claim 1, wherein the upwardly sloping second lateral end has a center, and the male coupling is located at the center of the upwardly sloping lateral second end.

8. The system of interlocking rig mats of claim 1, wherein the downwardly sloping first lateral end of the rig mat comprises two lateral ends, and each lateral end of the downwardly sloping first lateral end is covered by an end plate.

9. The system of interlocking rig mats of claim 1, wherein the upwardly sloping second lateral end of the rig mat comprises two lateral ends, and each lateral end of the upwardly sloping second lateral end is covered by an end plate.

10. The system of interlocking rig mats of claim 8 or 9, wherein the metal frame comprises two longitudinal side members, wherein the end plates are integral with the longitudinal side members of the metal frame.

11. The system of interlocking rig mats of claim 1, wherein the upwardly sloping second lateral end is in the form of a triangle comprised of two forty-five-degree angles and one ninety-degree angle.

12. The system of interlocking rig mats of claim 1, wherein the downwardly sloping first lateral end is in the form of a triangle comprised of two forty-five-degree angles and one ninety-degree angle.

13. The system of interlocking rig mats of claim 1, further comprising a plurality of lifting rings situated within wells integral to the metal frame, wherein each lifting ring is welded to a metal plate that is recessed at an angle within the well so that the lifting ring is flush with a top surface of the rig mat.

14. The system of interlocking rig mats of claim 1, further comprising one or more pins that extend through metal plates that are integral to the metal frame, wherein the pins secure the cross-laminated timber core to the metal frame.

* * * * *